US006432487B1

(12) United States Patent
Graham et al.

(10) Patent No.: US 6,432,487 B1
(45) Date of Patent: Aug. 13, 2002

(54) DENSE VERTICALLY CRACKED THERMAL BARRIER COATING PROCESS TO FACILITATE POST-COAT SURFACE FINISHING

(75) Inventors: Stephen Daniel Graham; Mark Francis DeSoi, both of Simpsonville, SC (US); Martin Lewis Smith, Easley, SC (US); Michael Wayne Wallace, Portland, TX (US); Robert Leighton Ling, Greer, SC (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/751,347

(22) Filed: Dec. 28, 2000

(51) Int. Cl.[7] ..... C23C 4/10; C23C 4/18

(52) U.S. Cl. ..... 427/454; 427/331; 427/355; 427/422; 427/427

(58) Field of Search ..... 427/453, 454, 427/455, 456, 331, 355, 356, 422, 427

(56) References Cited

U.S. PATENT DOCUMENTS 4,299,865 A * 11/1981 Clingman et al. ..... 427/243
4,613,259 A * 9/1986 Packer et al. ..... 406/14
5,281,487 A 1/1994 Rumaner et al.
5,830,586 A 11/1998 Gray et al.
5,897,921 A 4/1999 Borom et al.
5,989,343 A 11/1999 Borom et al.
6,022,594 A 2/2000 Borom et al.
6,047,539 A 4/2000 Farmer

* cited by examiner

*Primary Examiner*—Katherine A. Bareford
(74) *Attorney, Agent, or Firm*—Nixon & Vanderhye P.C.

(57) ABSTRACT

A process for applying a vertically cracked ceramic thermal barrier coating to a machine component includes a.) applying a plurality of layers of the ceramic thermal barrier coating on the component, utilizing a nozzle at a first distance from the component; b.) applying an additional sacrificial outer layer of the ceramic thermal barrier coating of the same chemical composition as the plurality of layers on the component, with the nozzle at a second distance from the component, greater than the first distance; and c) removing at least some of the outer layers to achieve thickness and surface roughness specifications.

18 Claims, No Drawings

DENSE VERTICALLY CRACKED THERMAL BARRIER COATING PROCESS TO FACILITATE POST-COAT SURFACE FINISHING

This invention relates generally to turbine components and, specifically, to coatings applied to turbine buckets, nozzles and the like.

BACKGROUND OF THE INVENTION

The so-called Dense Vertically Cracked ("DVC") Thermal Barrier Coating ("TBC") is a ceramic coating, and by definition, is dense, hard and difficult to abrade. Examples may be found in U.S. Pat. Nos. 6,047,539 and 5,830,586. See also U.S. Pat. Nos. 5,281,487; 5,897,921; 5,989,343; and 6,022,594. The thermal spray process (typically a plasma spray process) used to achieve the required structural characteristics (i.e., those that will produce the mechanical and thermal properties desired in the coating), however, also produces a rough surface that is aerodynamically unacceptable. The thickness control capability of this process is also less than the limits required by the design. Thus, the coating as applied must be thicker than the desired end product so that it can be mechanically abraded ("finished") to within the required limits of both thickness and surface roughness. This operation requires manual removal of excess material with diamond-impregnated disks, and has proven to be difficult, time consuming, and expensive, often resulting in rework resulting from "overfinishing," i.e., abrading to a thickness less than required.

All prior efforts that we are aware of appear to have centered around finding a more effective media (i.e., ceramics other than diamond) to use in the finishing operation.

BRIEF SUMMARY OF THE INVENTION

This invention involves the creation of a thin, soft (i.e., less dense), sacrificial outer layer of the TBC that is easily removed by "conventional" finishing techniques and materials. The ability to apply this thin, soft sacrificial layer of the same chemical composition enables the surface finishing operation to be performed more rapidly. Because it will be noticeably easier to remove than the fully dense layers of coating beneath it, it provides an inherent "fail-safe" indicator. In other words, a finishing operator will be immediately aware that most of the sacrificial layer has been removed by the sudden increase in removal difficulty that will then warn that minimum thickness limits are being approached. Thus, the approach should minimize the potential for "overblending" (i.e., removal of too much coating during finishing, resulting in under minimum thickness requirements). Because this soft outer layer will be easier and faster to remove, it will reduce the time and the number of diamond impregnated disks required to finish a component by approximately 50%. This technique also facilitates achieving the surface roughness requirements in that the softer outer layer will fill the surface irregularities or "pockets" in the harder underlayer, thus providing a smoother surface.

Accordingly, in its broader aspects, the invention relates to a process for applying a thermal barrier coating to a machine component comprising:

a. applying a plurality of layers of the thermal barrier coating on the component, utilizing a nozzle at a first predetermined distance from the component; and b. applying an outer layer of said thermal barrier coating on the component, with the nozzle at a second distance from the component, greater than said first distance.

In another aspect, the invention relates to a process for coating and surface finishing a machine component to provide a final coating of predetermined thickness and surface roughness comprising:

a. spraying a plurality of layers of a ceramic thermal barrier coating on the component, utilizing a spray nozzle at a first distance from the component;

b. spraying an outer layer of the ceramic thermal barrier coating on the component, with the spray nozzle at a second, greater distance from the component; and c. abrading the outer layer to thereby remove some or all of the outer layer to achieve a predetermined final coating thickness and desired surface roughness.

In still another aspect, the invention relates to a process for applying a dense, hard, ceramic thermal barrier coating on a turbine component comprising:

a. spraying a plurality of layers of a ceramic thermal barrier coating on the turbine component, utilizing a plasma-spray torch at a first distance from the component;

b. plasma-spraying a sacrificial layer of the ceramic thermal barrier coating on the turbine component, with the plasma-spray torch at a second, greater distance from the turbine component to thereby make the sacrificial layer less dense than the plurality of layers; and c. abrading the sacrificial layer to thereby remove some or all of the sacrificial layer to achieve a desired final coating thickness and surface roughness.

DETAILED DESCRIPTION OF THE INVENTION

The current process involves a ceramic Thermal Barrier Coating (TBC). The coating is applied in a series of layers, applied one at a time, using a specifically designed program for the particular component to be coated.

In one embodiment, the ceramic material may be a metal oxide, such as yttria stabilized zirconia having a composition of 6–8 weight percent yttria with a balance of zirconia that is built up by plasma-spraying a plurality of layers. However, this invention is applicable to other TBC materials including metallic carbides, nitrides and other ceramic materials. A layer is defined as the thickness of ceramic material deposited in a given plane or unit of area during one pass of a plasma-spray torch. In order to cover the entire surface of a substrate and obtain the necessary thickness of a TBC, it is generally desirable that the plasma-spray torch and the substrate be moved in relation to one another when depositing the TBC. This can take the form of moving the torch, substrate, or both, and is analogous to processes used for spray painting. This motion, combined with the fact that a given plasma-spray torch sprays a pattern which covers a finite area (e.g., has a torch footprint), results in the TBC being deposited in layers.

In one exemplary embodiment, the process consists of eight (8) spray passes with the torch or nozzle located a distance of about 4.5 inches from the component to be coated, using a computer-controlled program with robotic motion for reproducibility.

This process produces a uniformly hard, dense, ceramic coating, adding about 0.002" per pass for a total thickness of approximately 0.016". This allows for about 0.002" to be abraded during the surface finishing operation that is required to achieve the required surface roughness and thickness specifications.

The invention here is a modification to this otherwise known process. Specifically, this invention adds one additional pass of the plasma-spray torch, using the same parameters and motions as in all of the prior passes, except that the last pass is made from a distance of about 11.0" (more than 2×the distance for the first 8 passes). This added distance creates an outer "sacrificial" layer that is less dense, i.e., more porous. The additional porosity is what makes this outer layer softer and easier to abrade. Removal of this relatively soft outer layer can be accomplished with conventional surface finishing materials in about half the time it would take to remove the same thickness of the denser underlayers. In fact, the removal of this outer layer requires so little effort in comparison to the effort required to abrade the dense underlayer that it is "self-alarming" to an operator. More specifically, the change in hardness, as reflected in the level of effort required to remove the soft versus the harder coating, announces emphatically to the operator that the soft layer is depleted and the adjacent hard layer is now being worked. This effect will reduce overworking of the coating that results in wasted, nonvalue-added surface finishing, and/or overwork to below thickness minimums resulting in the need to strip and re-coat the product.

Typically, in order to meet the thickness and surface roughness specifications, most of the outer sacrificial layer will be removed (sometimes, all of the outer layer may be removed). However, the remaining outer layer material will fill the surface irregularities or "pockets" in the harder, adjacent underlayer, providing a smoother surface. In this way, both the desired thickness and surface finish characteristics can be obtained with far less effort than previously required.

Coating quality using this process was evaluated metallographically against the production standard and found to be comparable to current production.

Production records also show that it takes an average of 1.7 diamond-impregnated disks to grind the surface of one turbine bucket coated with the conventional DVC-TBC to the required surface finish. There are approximately 0.245 labor hours required to achieve the required surface finish. 1.44% of buckets processed required stripping and recoating as a result of "overblending" (where the operator(s) ground the coating to below the minimum thickness limits). Evaluations of this new coating procedure have demonstrated that one turbine bucket requires an average of 1.1 such diamond-impregnated disks to achieve the required surface finish, and that average finishing time required on turbine buckets with this softer outer layer was 0.153 labor hours.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A process for applying a vertically cracked ceramic thermal barrier coating to a machine component comprising:

a. applying a plurality of layers of the ceramic thermal barrier coating on the component, utilizing a nozzle at a first distance from the component;

b. applying an additional sacrificial outer layer of said ceramic thermal barrier coating of the same chemical composition as said plurality of layers on the component, with the nozzle at a second distance from the component, greater than said first distance; and c. removing at least some of said outer layer to achieve thickness and surface roughness specifications.

2. The process of claim 1 wherein said second distance is more than twice said first distance.

3. The process of claim 1 wherein each of said plurality of layers and said outer layer are applied by plasma spraying.

4. The process of claim 1 wherein each of said plurality of layers is about 0.002" thick.

5. The process of claim 4 wherein said outer layer is about 0.002" thick.

6. The process of claim 1 wherein said outer layer, after step b), is about 0.002" thick.

7. The process of claim 1 wherein said first distance is about 4.5 inches and said second distance is about 11 inches.

8. The process of claim 1 wherein said plurality of layers comprise eight layers.

9. The process of claim 1 wherein said outer layer is less dense than said plurality of layers.

10. A process of coating and surface finishing a machine component to provide a final coating of predetermined thickness and surface roughness comprising:

a. spraying a plurality of layers of a ceramic thermal barrier coating on the component, utilizing a spray nozzle at a first distance from the component;

b. spraying an additional, sacrificial outer layer of said ceramic thermal barrier coating on the component, with the spray nozzle at a second, greater distance from the component; and c. abrading said outer layer to thereby remove substantially all of said outer layer such that a remaining outer layer fills surface irregularities in a next adjacent layer, thereby providing a smooth surface on said final coating.

11. The process of claim 10 wherein each of said plurality of layers is about 0.002" thick.

12. The process of claim 11 wherein said outer layer, prior to step c), is about 0.002" thick.

13. The process of claim 10 wherein said first distance is about 4.5 inches and said second distance is about 11 inches.

14. The process of claim 10 wherein said plurality of layers comprise eight layers.

15. A process for applying a dense, hard, ceramic, vertically cracked thermal barrier coating on a turbine component comprising:

a. spraying a plurality of layers of a ceramic thermal barrier coating on the turbine component, utilizing a plasma-spray torch at a first distance from the component, each layer having a thickness of about 0.002";

b. plasma-spraying an additional sacrificial layer of said ceramic thermal barrier coating of the same chemical composition as said plurality of layers on the turbine component, with the plasma-spray torch at a second, greater distance from the turbine component to thereby make the sacrificial layer less dense than said plurality of layers, said sacrificial layer having a thickness of about 0.002"; and c. abrading said sacrificial layer to thereby remove some or all of said sacrificial layer to achieve a desired final coating thickness and surface roughness.

16. The process of claim 15 wherein said second distance is more than twice said first distance.

17. The process of claim 15 wherein said first distance is about 4.5 inches and said second distance is about 11 inches.

18. The process of claim 15 herein said plurality of layers comprise eight layers.

* * * * *

UNITED STATES PATENT AND TRADEMARK OFFICE

CERTIFICATE OF CORRECTION

PATENT NO. : 6,432,487 B1
DATED : August 13, 2002
INVENTOR(S) : Wallace et al.

It is certified that error appears in the above-identified patent and that said Letters Patent is hereby corrected as shown below:

Column 4,
Line 34, delete “11” and insert -- 10 --.
Line 64, delete “herein”and insert -- wherein --.

Signed and Sealed this

Twelfth Day of November, 2002

*Attest:*

*Attesting Officer*

JAMES E. ROGAN
*Director of the United States Patent and Trademark Office*

UNITED STATES PATENT AND TRADEMARK OFFICE

CERTIFICATE OF CORRECTION

PATENT NO. : 6,432,487 B1
APPLICATION NO. : 09/751347
DATED : August 13, 2002
INVENTOR(S) : Wallace et al.

It is certified that error appears in the above-identified patent and that said Letters Patent is hereby corrected as shown below:

In Column 1, immediately below the title, insert:

--The Government of the United States of America has rights in this invention pursuant to Contract No. DE-FC21-95MC31176 awarded by the U. S. Department of Energy.--

Signed and Sealed this

Twentieth Day of February, 2007

JON W. DUDAS
*Director of the United States Patent and Trademark Office*